United States Patent [19]

Bergman

[11] 4,258,513

[45] Mar. 31, 1981

[54] SPACE ENCLOSING STRUCTURE

[76] Inventor: Helmut Bergman, 116 Newport Ave., Scarborough, Ontario, Canada, M1L 1J5

[21] Appl. No.: 64,756

[22] Filed: Aug. 8, 1979

[51] Int. Cl.[3] ..... E04B 1/32

[52] U.S. Cl. ..... 52/81; 52/DIG. 10

[58] Field of Search ..... 52/80–82, 52/DIG. 10

[56] References Cited

U.S. PATENT DOCUMENTS

| | | | |
|---|---|---|---|
| 3,611,620 | 10/1971 | Perry | 52/81 X |
| 3,722,153 | 3/1973 | Baer | 52/81 |
| 3,810,336 | 5/1974 | Sadao | 52/81 |
| 3,854,255 | 12/1974 | Baker | 52/81 |
| 4,160,345 | 7/1979 | Nalick | 52/81 |

FOREIGN PATENT DOCUMENTS

| | | | |
|---|---|---|---|
| 1458056 | 10/1966 | France | 52/DIG. 10 |
| 166809 | 4/1934 | Switzerland | 52/DIG. 10 |
| 2410 | of 1913 | United Kingdom | 52/DIG. 10 |

OTHER PUBLICATIONS

Domebook 2, Aug. 1971, pp. 102–103, "Pacific Domes."

*Primary Examiner*—J. Karl Bell

*Attorney, Agent, or Firm*—George H. Riches

[57] ABSTRACT

A space enclosing structure, the underlying shape of which is a portion of a polyhedron comprised of a regular arrangement of regular pentagons, equilateral triangles, right angled parallelograms and rhombi. The structure permits the use of square or rectangular standardized prefabricated square or rectangular building units, such as doors, windows, solar panels, etc., without any alteration of the basic shape of the structure, as such prefabricated units may be used to replace any of the square or rectangular faces of the polyhedron. Each face other than a right angled parallelogram is abutted on each side by a right angled parallelogram. Each right angled parallelogram is abutted on two opposite sides by rhombi and on the other two sides by a pentagon and a triangle.

12 Claims, 5 Drawing Figures

SPACE ENCLOSING STRUCTURE

BACKGROUND OF THE INVENTION

Space enclosing structures in the shape of "geodesic" polyhedral domes employing a minimum of regular geometric shaped surfaces have become increasingly popular over the last twenty-five years. These structures have been used, amongst other things, for buildings of all sizes. The large volume-to-surface area ratio has made them expecially appealing to those in the building trade as the cost of building materials increases.

One major problem encountered with adapting these structures as standardized housing and the like is that most building materials, such as plywood sheeting, and prefabricated units, such as windows or solar heating panels, are rectangular or square in shape. Most structures known teach the use of nonrectangular units, such as triangles, pentagons and hexagons from which the structure is constructed. If a window is to be inserted, it must be specially shaped to one of these three designs, or alternatively, the dome unit must be adapted to accept a standard square or rectangular unit. Both of these procedures increase construction time and costs.

The applicant is familiar with a rhombicosadodecahedronal structure which can use square building units. However, the small number of surface units defining the polyhedral structure based on this shape, namely 62, restricts the size of same when using ordinarily (4'×8') sized prefabricated structures.

BRIEF DESCRIPTION OF THE INVENTION

Accordingly, it is an object of the present invention to provide a polyhedral dome-like space enclosing structure, which may conveniently be used as a design for buildings and the like, wherein the structure includes square or rectangularly shaped areas on the surface thereof. This allows the use of standard form structures such as rectangular windows, grating, air conditioners, solar panels, and the like without any adjustment of the surfaces defining the dome.

To this end, in one of its aspects, the invention provides a space enclosing structure having an outer edge comprising a dome-like portion of a structure comprising:

(a) a plurality of elements;

(b) the elements being oriented in a relationship to each other so that the elements contact each other defining a plurality of planar shapes, or a shape comprising a non-planar combination of at least two of the said planar shapes, wherein each of the planar shapes is equivalent to each other same shaped planar shapes, each of said planar shapes being one of a regular pentagon, an equilateral triangle, a right angled parallelograms or a rhombus;

(c) the arrangement of the planar shapes being such that each planar shape other than a right angled parallelogram planar shape is abutted on each side by a right angled parallelogram planar shape, no right angled parallelogram planar shapes abut on a side with any other right angled parallelogram planar shape;

(d) each one of all the acute vertices of each rhombic planar shape abuts a vertice of a pentagon planar shape;

(e) each obtuse vertice of each rhombic planar shape abuts a triangle planar shape vertice.

In another of its aspects the invention further provides a dome-like portion of a space enclosing structure comprising a plurality of interconnected straight connecting members, each coterminus with three other of the members;

the members interconnected to define the boundaries of a plurality of areas, which areas are regular pentagons, equilateral triangles, right angled parallelograms or rhombi;

each member defining a part of a boundary of one of the areas on each of its two sides, each member defining a part of a boundary of one of the right angled parallelograms on one side and a part of a boundary of another of the areas on the other side or being an outer edge of the structure, each set of four coterminus members having two members defining a part of the boundary of one of the pentagons or one of the triangles and the other two members defining half of the boundary of a rhombus, each pentagon, triangle, right angled parallelogram and rhombus being identically sized to each other pentagon, triangle, right angled parallelogram and rhombus, respectively.

BRIEF DESCRIPTION OF THE DRAWINGS

Further objects and advantages of the invention will appear from the following description taken together with the accompanying drawings in which.

DESCRIPTION OF THE PREFERRED EMBODIMENTS

Structures of the type of the present invention may be defined either by the orientation of skeletal brace members 12 to which the wall covering units are applied or by the orientation of the repeating planar geometric shapes, corresponding to the faces 10, which define the outer shape of the structure. The following description will make use of both methods of defining the structure. The structure is in effect a portion of a polyhedron of four different geometric shapes, or that same structure wherein some of the faces have been replaced with non-planar faces.

Figure 1:
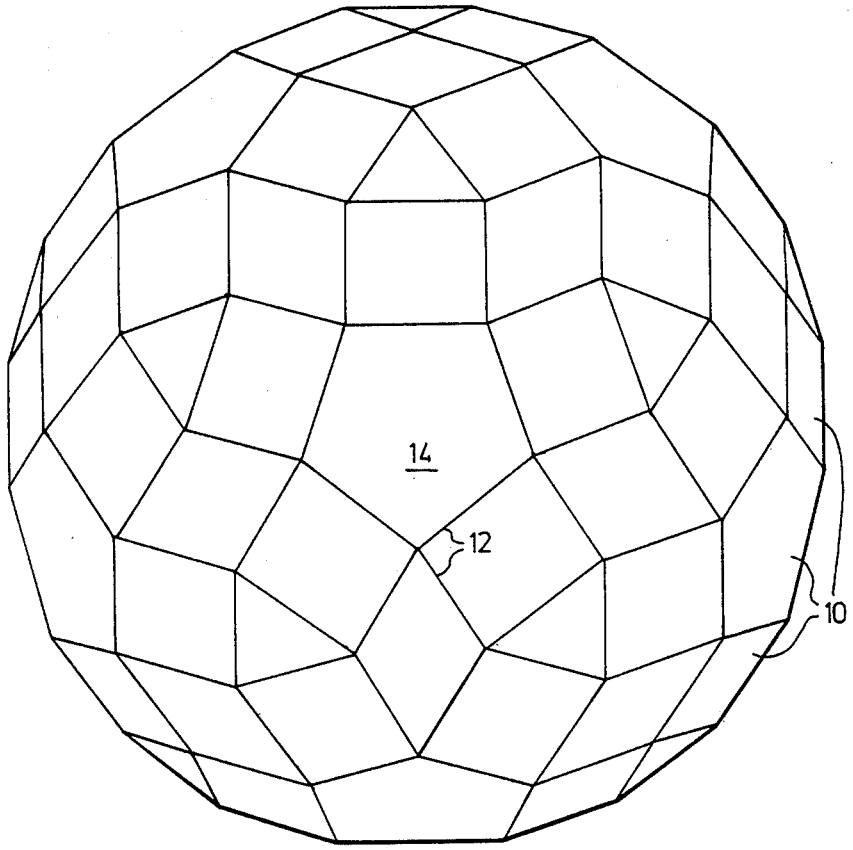
FIG. 1 is a top view of a preferred embodiment of an assembled hemispherically shaped space enclosing structure constructed using, in part, square portions.
Figure 2:
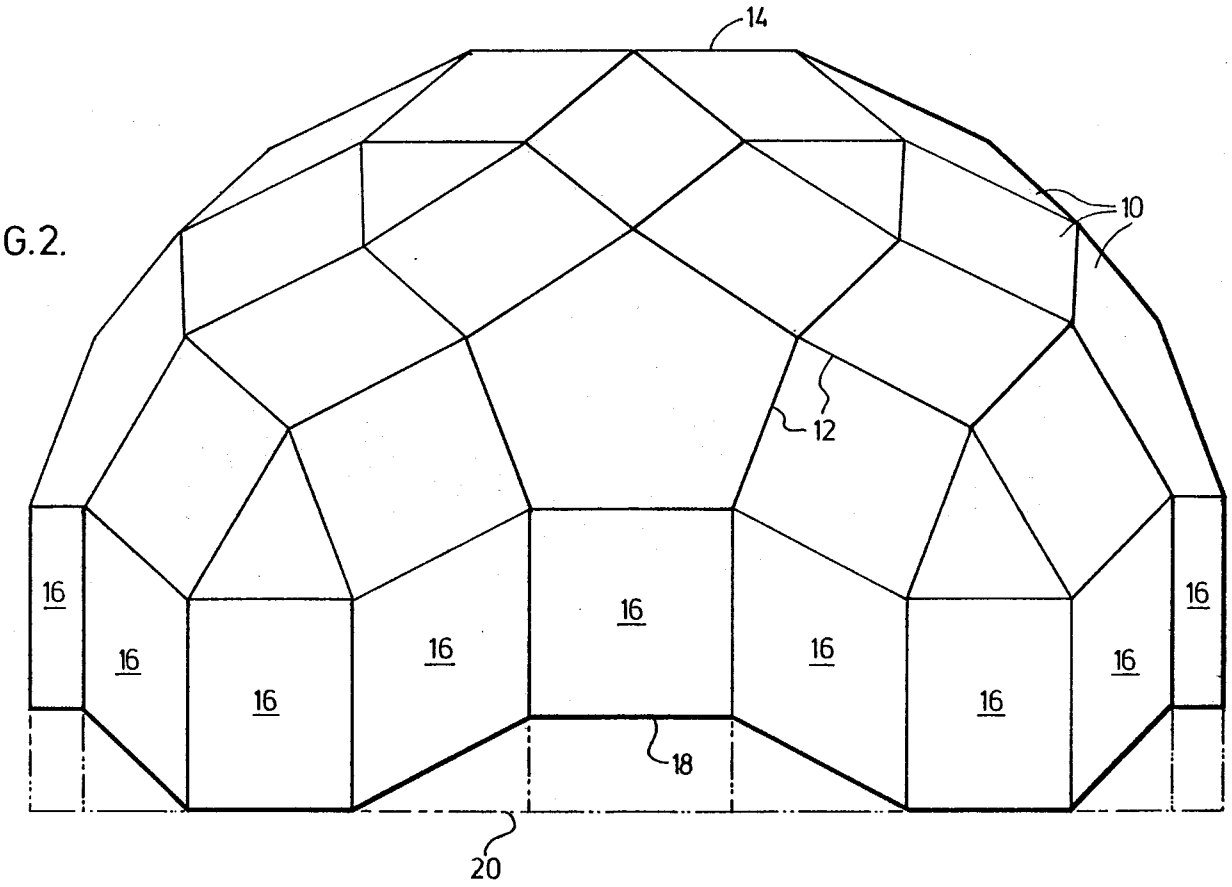
FIG. 2 is a side view of the preferred embodiment shown in FIG. 1.
Figure 3:
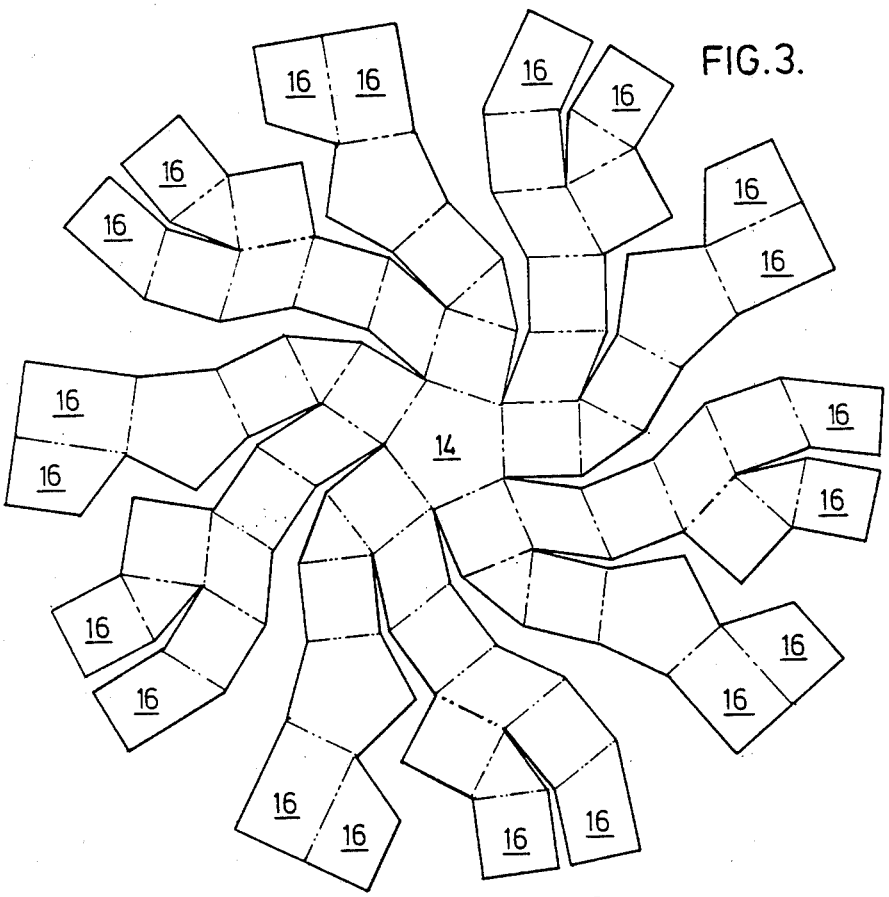
FIG. 3 is a schematic illustration of the pattern of arrangement of shapes employed to form the structure shown in FIGS. 1 and 2.
Figure 4:
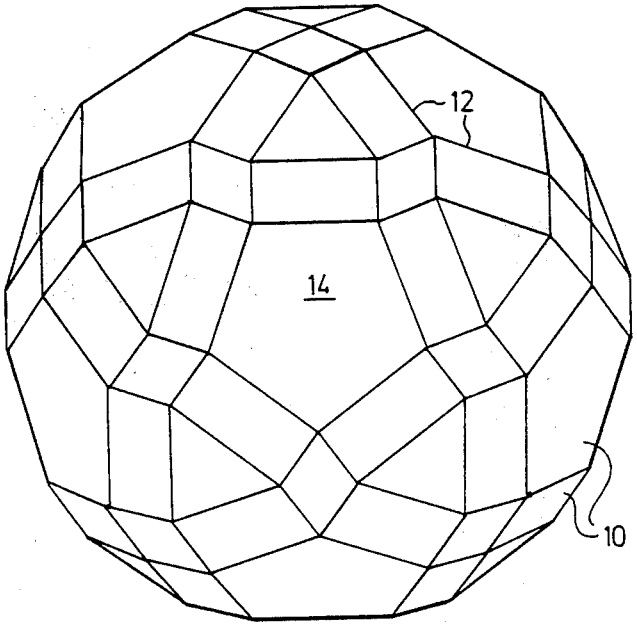
FIG. 4 is a top view of another preferred embodiment, as shown in FIG. 1, wherein the squares are replaced by rectangles.

The fundamental shape is as shown in FIGS. 1 and 2. The only distinction between FIGS. 1 and 4 is the shape of the right angled parallelograms used. The shape of this unit can be chosen so that it most easily accommodates the standard form building structure, such as windows, prefabricated wall panels and doors, being used.

The angular orientation of each of the faces 10 defining the basic structure are fixed whatever the shape of the right angled parallelogram. The size of each other unit is also fixed once the size of the right angled parallelogram is fixed. If a square is used then each edge of each unit is the same length. The advantages in ordering building supplies are obvious in this instance. If the right angled parallelogram chosen is rectangular in shape then the brace members 12 will be of two different lengths, the two lengths corresponding to the two lengths of the sides of the rectangular face.

The faces 10 are shaped as regular pentagons, equilateral triangles, right angled parallelograms (squares or triangles) and rhombi. Each pentagon and each triangle is abutted on each side by a side of a right angled parallelogram, and each right angled parallelogram is abutted on one side by a pentagon and on the opposite side by a triangle. Rhombi abut the other two opposing sides of each right angled parallelogram. The sides of rhombi only abut the sides of right angled parallelograms.

The orientation of shapes in this invention produces an additional advantage in that all the vertices of the structure are of one of two sets, that set defined by a triangle, two right angled parallelograms and a rhombus that set defined by a pentagon, two right angled parallelograms and a rhombus. This implies that only two prefabricated joint members are required to connect the skeletal brace members 12. This greatly simplifies the building procedures.

If for any reason one set of the vertices should be moved towards or away from the centre of the structure, this can be done by replacing each rhombus with a pair of non-planar isosoles triangles, the particular vertices being moved being retained in the isosoles triangles.

This arrangement produces the shaped structures shown in FIGS. 1, 2 and 4 only. So far as the applicant is aware no other arrangement of these shapes to produce a space enclosing structure is possible.

Figure 5:
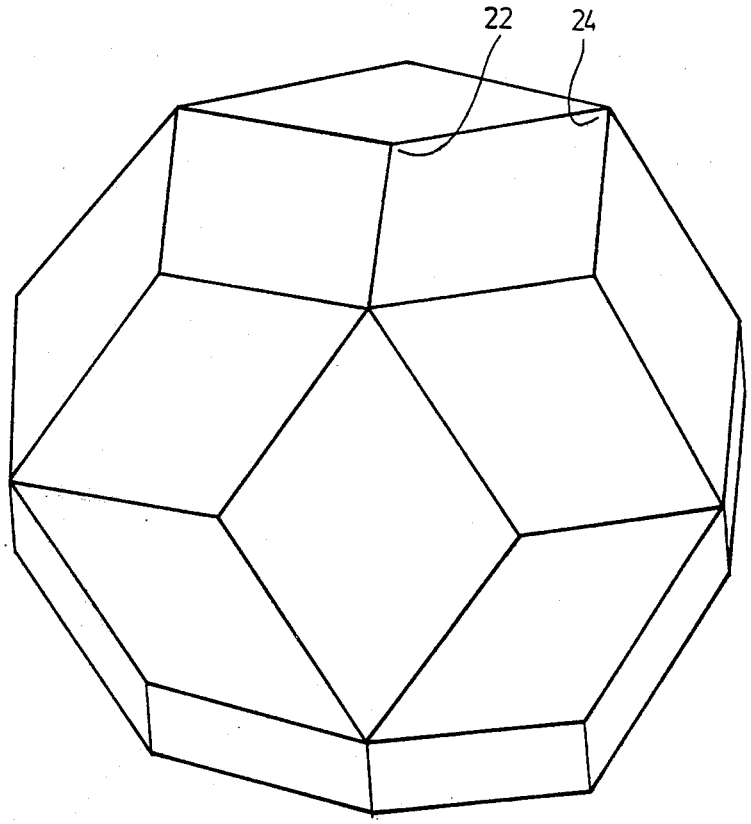
FIG. 5 is a perspective view of a rhombic triacontahedron.

The structure in FIGS. 1 to 4 is derived from the structure shown in FIG. 5, a rhombic triacontahedron. Each rhombus is displaced into a respectively parallel plane and is connected along its sides by right angled parallelograms to the sides of the adjacent rhombi. In a rhombic triacontahedron the rhombi meet at apexes defined by three obtuse vertices 22 or five acute vertices 24. Between the three obtuse vertices 22 is an equilateral triangle and between the five acute vertices 24 is a regular pentagon. The vertices of the rhombi touch the vertices of the triangles and pentagons. The angles at the obtuse and acute vertices are 116° 33′ 54″ and 63° 26′ 06″ respectively.

The drawings in the figures all show a central, or uppermost, or polar face 14 which is pentagonal in shape. This is the applicant's preferred structure. By so arranging the orientation of the faces 10 in this manner, when the polar face 14 is parallel to the ground or support upon which it is sitting then a plurality of vertical, or equatorial faces 16 are created. The lower edges 18 of the equatorial faces 16 can be extended to create an extended coplanar lower edge 20 which is parallel to the polar face 14 (see FIG. 2). An obvious advantage of the structure in FIG. 2 as an architectural design for a building is the fact that these equatorial faces 16 can be fitted with vertically oriented doors or windows without substantial expense as would be required if they were not vertical.

When considering what shape the right angled parallelograms are to be, consideration should be given to factors such as the desired shape of equatorial faces 16. By varying the amount of the extension of the edge 20, the desired length of an equatorial face 16 can be achieved. Window or solar heating panel sizes should also be considered as these can easily replace right angled rectangular panels on the surface of the structure without extensive working. With twenty-five right angled parallelogram shaped areas in a hemispherically shaped structure as shown in the figures, other than as equatorial faces 16, a properly oriented right angled parallelogram surface can always be found in which to locate windows, solar panels and the like.

The description above is but a description of preferred embodiments. It is possible to replace some of the different planar geometric shaped faces 10 with other shaped faces. For instance, each pentagon face could be replaced with an arrangement of five triangular faces which may or may not be coplanar. The bases of each of the five triangles will be coplanar, though. It is the shape defined by the bases of the triangles, one of each of which corresponds to a skeletal brace member 12, which is included within a feature of this invention. Any individual face 10 may be replaced with any type of non-planar surface, but that non-planar surface meets or intersects the other faces along a locus of points equivalent to the locations of the brace members 12.

It is also possible to span the area defined by two or more faces 10 with a single non-planar surface. This however defeats the advantages of the present invention wherein a few sizes of simply shaped units can be assembled into a space enclosing structure.

The hemispherical structure shown in the Figures is not the only possible structure. The structure may be more or less enclosing than the preferred structure. One of the advantages of the preferred structure is, however, the possibility of vertically oriented equatorial walls 16 which can be adjusted to have a coplanar base 20. This simplifies the construction of supporting structures, such as poured concrete bases, as well.

Another advantage of the preferred embodiment is that horizontal members, such as floors in buildings, can be easily oriented against the surface of the structure. The five fold symmetry of the structure implies that there are at least four points indentically placed corresponding to each other point. Each of these five identically placed points will be identically displaced above the coplanar base 20 and so define a plane coplanar to base 20. Once the supporting structure for the base 20 is fixed and levelled, then each of these other planes will also be level. This will greatly simplify construction procedures for the unsophisticated builder.

Although the description of this invention has been given with respect to a particular embodiment, it is not to be construed in a limiting sense. Many variations and modifications will now occur to those skilled in the art. For a definition of the invention reference is made to the appended claims.

What I claim is:

1. A space enclosing structure having an outer edge comprising a dome-like portion of a structure comprising:

(a) a plurality of elements;

(b) the elements being oriented in a relationship to each other so that the elements contact each other defining a plurality of planar shapes, or a shape comprising a non-planar combination of at least two of the said planar shapes, wherein each of the planar shapes is equivalent to each other same shaped planar shapes, each of said planar shapes being one of a regular pentagon, an equilateral triangle, a right angled parallelogram or a rhombus;

(c) the arrangement of the planar shapes being such that each planar shape other than a right angled parallelogram planar shape is abutted on each side by a right angled parallelogram planar shape, no right angled parallelogram planar shapes abut on a side with any other right angled parallelogram planar shape;

(d) each one of all the acute vertices of each rhombic planar shape abuts a vertice of a pentagon planar shape;

(e) each obtuse vertice of each rhombic planar shape abuts a triangle planar shape vertice.

2. A space enclosing structure as claimed in claim 1 wherein each of the elements are planar faces shaped as one of the planar shapes.

3. A space enclosing as claimed in claim 2 wherein each edge of each planar face is of the same length.

4. A space enclosing structure as claimed in claims 1, 2 or 3 wherein the dome-like structure approximates a hemisphere having a single polar face, comprising a pentagonal shape, and a plurality of equitorial faces each of which is one of the parallelogram shapes and each having an edge not common to any other face, the equatorial faces being distorted so that the edges not common to any other face are coplanar and parallel to the polar face.

5. A dome-like portion of a space enclosing structure comprising a plurality of interconnected straight connecting members, each coterminus with three other of the members;

the members interconnected to define the boundaries of a plurality of areas, which areas are regular pentagons, equilateral triangles, right angled parallelograms or rhombi;

each member defining a part of a boundary of one of the areas on each of its two sides, each member defining a part of a boundary of one of the right angled parallelogram on one side and a part of a boundary of another of the areas on the other side or being an outer edge of the structure, each set of four coterminus members having two members defining a part of the boundary of one of the pentagons or one of the triangles and the other two members defining half of the boundary of a rhombus;

each pentagon, triangle, right angled parallelogram and rhombus being identically sized to each other pentagon, triangle, right angled parallelogram and rhombus, respectively.

6. A portion of a space enclosing structure as defined in claim 5 wherein the members are all of the same length.

7. A portion of a space enclosing structure as defined in claim 6 wherein there exists a centrally located polar pentagonal area and a plurality of equatorial areas each having outer edges, the members connected to the members defining the outer edge being of such lengths that all the members defining the outer edge are coplanar.

8. A space enclosing substantially hemispheric structure with an outer edge comprising at least a portion of a complete polyhedral structure formed by a plurality of planar faces, wherein the faces are regular pentagons, equilateral triangles, squares and rhombi, all the sides of all the faces being equal in length, wherein in the complete structure each pentagon, rhombus and triangle is abutted on each side by a square, no squares abut each other and each acute angled corner of each rhombus abuts a corner of a pentagon, and wherein in the hemispherically shaped structure those faces defining the outer edge only abut three other faces.

9. A space enclosing structure as defined in claim 8 wherein the portion is roughly hemispherical in shape having a single polar face and a plurality of equatorial faces, which are the faces defining the outer edge, the polar face being a pentagonally-shaped face.

10. A space enclosing structure as claimed in claim 9 wherein the equatorial faces are extended so that the edge of each equatorial face not common to any other face all lie in a single plane which is parallel to the plane defined by the polar face.

11. A space enclosing structure as defined in any of claims 8, 9 or 10 wherein at least one or more faces, defined by an exterior edge, are replaced by another form which abuts the structure along the exterior edge.

12. A space enclosing structure comprising a dome-like portion of a polyhedron, wherein the polyhedron is a rhombic triacontahedron in which the rhombi meet to form apexes on the polyhedron comprising three obtuse vertices of three rhombi or five acute vertices of five rhombi, wherein a right angled parallelogram is interposed between adjoining sides of each rhombus, an equilateral triangle is interposed between the three obtuse vertices, and a regular polygon is interposed between the five acute vertices.

* * * * *